US006561441B1

(12) United States Patent
Hsieh

(10) Patent No.: US 6,561,441 B1
(45) Date of Patent: May 13, 2003

(54) KITCHEN-USED SPRINKLING GUN

(76) Inventor: Max Hsieh, No. 78, Lane 234, Sec. 3, Chang-Nan Rd., Changhua City (TW)

( * ) Notice: Subject to any disclaimer, the term of this patent is extended or adjusted under 35 U.S.C. 154(b) by 0 days.

(21) Appl. No.: 10/215,007

(22) Filed: Aug. 9, 2002

(51) Int. Cl.[7] ..... B05B 7/02

(52) U.S. Cl. ..... 239/525; 239/526

(58) Field of Search ..... 239/525, 526, 239/583, 436, 443, 446, 447

(56) References Cited

U.S. PATENT DOCUMENTS 5,333,792 A * 8/1994 Wang ..... 239/440
5,806,771 A * 9/1998 Loschelder et al. ..... 239/446
6,279,839 B1 * 8/2001 Chang ..... 239/525

* cited by examiner

*Primary Examiner*—Lisa A. Douglas
(74) *Attorney, Agent, or Firm*—Rosenberg, Klein & Lee

(57) ABSTRACT

A kitchen-used sprinkling gun including a main body, a cap body and a switch unit. The cap body is clockwise and counterclockwise rotatably disposed on the main body. The cap body is formed with a central outlet section and a circumferential outlet section. The switch unit is disposed in the cap body. A spring serves to push a valve body to optionally seal one of two dividing holes of a water dividing disc. The two dividing holes respectively communicate with the central outlet section and the circumferential outlet section. A water generator is disposed between one dividing hole and the central outlet section. When a user turns the cap body, the water dividing disc is driven, whereby the flowing path of the water can be changed to discharge the water in different patterns.

6 Claims, 5 Drawing Sheets

KITCHEN-USED SPRINKLING GUN

BACKGROUND OF THE INVENTION

A present invention is related to a kitchen-used sprinkling gun including a switch unit having small volume. By means of the switch unit, the sprinkling gun can be switched between different discharging modes as necessary.

FIG. 5 shows a conventional kitchen-used sprinkling gun 8. The sprinkling gun 8 has a handle 81. One end of the handle 81 is an inlet section 82, while the other end thereof is an outlet section 83. The handle 81 is formed with an internal passage 84 for the water flow. A press shank 85 is pivotally connected with the handle 81 for driving a valve body 86 to control the opening/closing of the passage 84.

Strong water beams are directly injected out from the outlets 831 of the outlet section 83 for cleaning off the oily dirt remaining on a dish. The directly injected water beams tend to splash around to wet and contaminate the environment of the water sink of the kitchen.

In order to solve this problem, the water flow must be waved so as to reduce the strength of the injected water beams as necessary. Therefore, it is preferably that the kitchen-used sprinkling gun can be switched between a directly injecting mode and a wave generating mode. However, the kitchen-used sprinkling gun is connected with a water pipe (not shown) and arranged on one side of the water sink of the kitchen cabinet. The sprinkling gun, especially the outlet section 83 thereof must be designed with small volume so as not to interfere with the work of a user in front of the kitchen cabinet. Accordingly, under limitation to the volume of the outlet section 83, an existent switch unit (such as that used in a shower sprinkler or gardening sprinkling gun) cannot be adapted to the kitchen-used sprinkling gun. Therefore, it is necessary to re-design the existent kitchen-used sprinkling gun to meet the above requirement.

SUMMARY OF THE INVENTION

It is therefore a primary object of the present invention to provide a kitchen-used sprinkling gun including a switch unit. The switch unit includes a water dividing disc formed with a first and a second dividing holes respectively communicating with the central outlet section and the circumferential outlet section of the cap body. A water generator is disposed between the first dividing hole and the central outlet section. By means of turning the cap body, the water dividing disc can be rotated, whereby a valve body can optionally seal the first dividing hole or the second dividing hole to change the discharging patterns. Accordingly, even if the volume of the kitchen-used sprinkling gun is limited, the kitchen-used sprinkling gun can be still switched between different discharging modes.

It is a further object of the present invention to provide the above kitchen-used sprinkling gun which can be conveniently operated. Only by means of turning the cap body, the discharging pattern can be easily changed.

The present invention can be best understood through the following description and accompanying drawings wherein:

DETAILED DESCRIPTION OF THE PREFERRED EMBODIMENT

Figure 1:
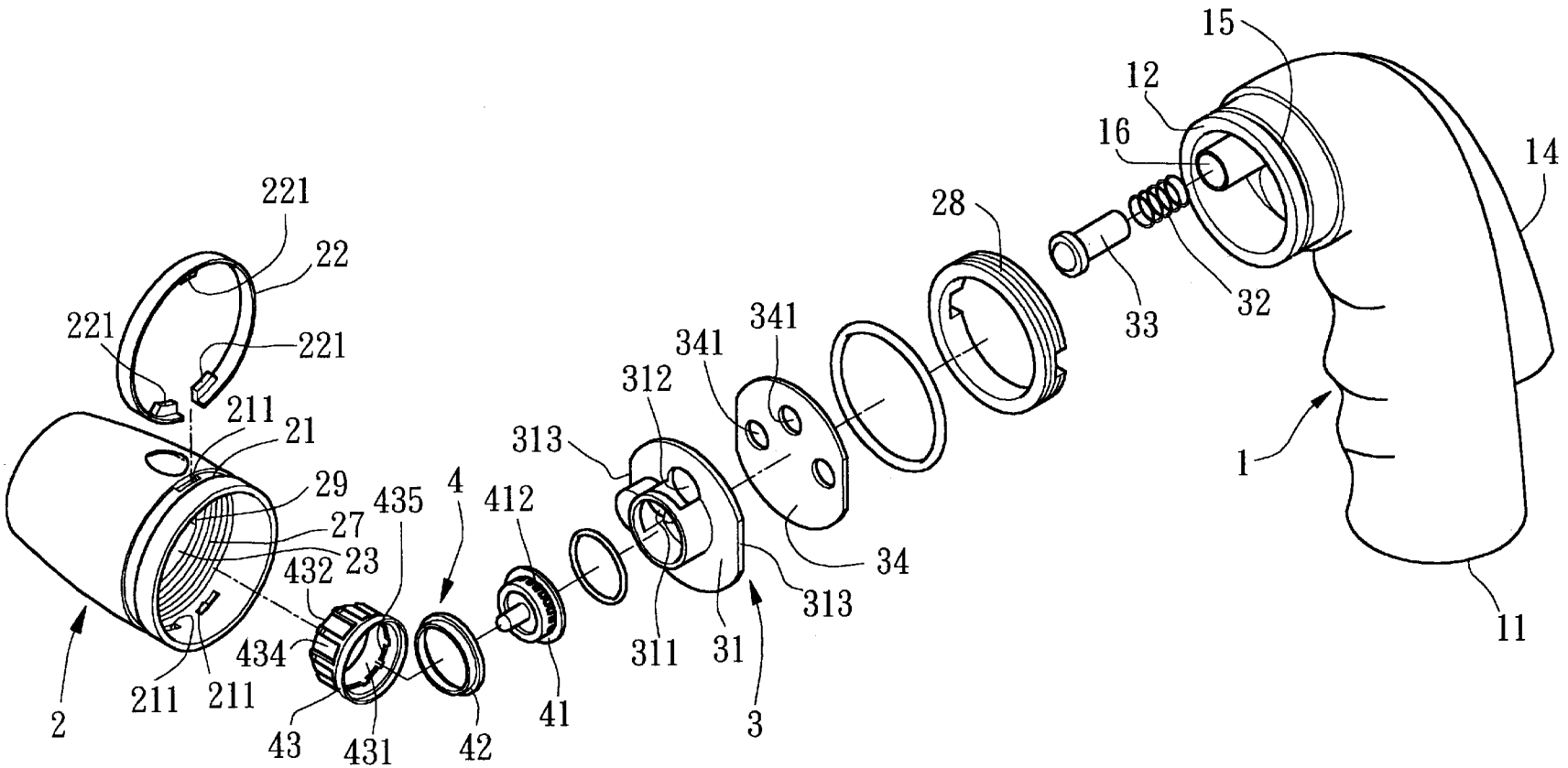
FIG. 1 is a perspective exploded view of the present invention.
Figure 2:
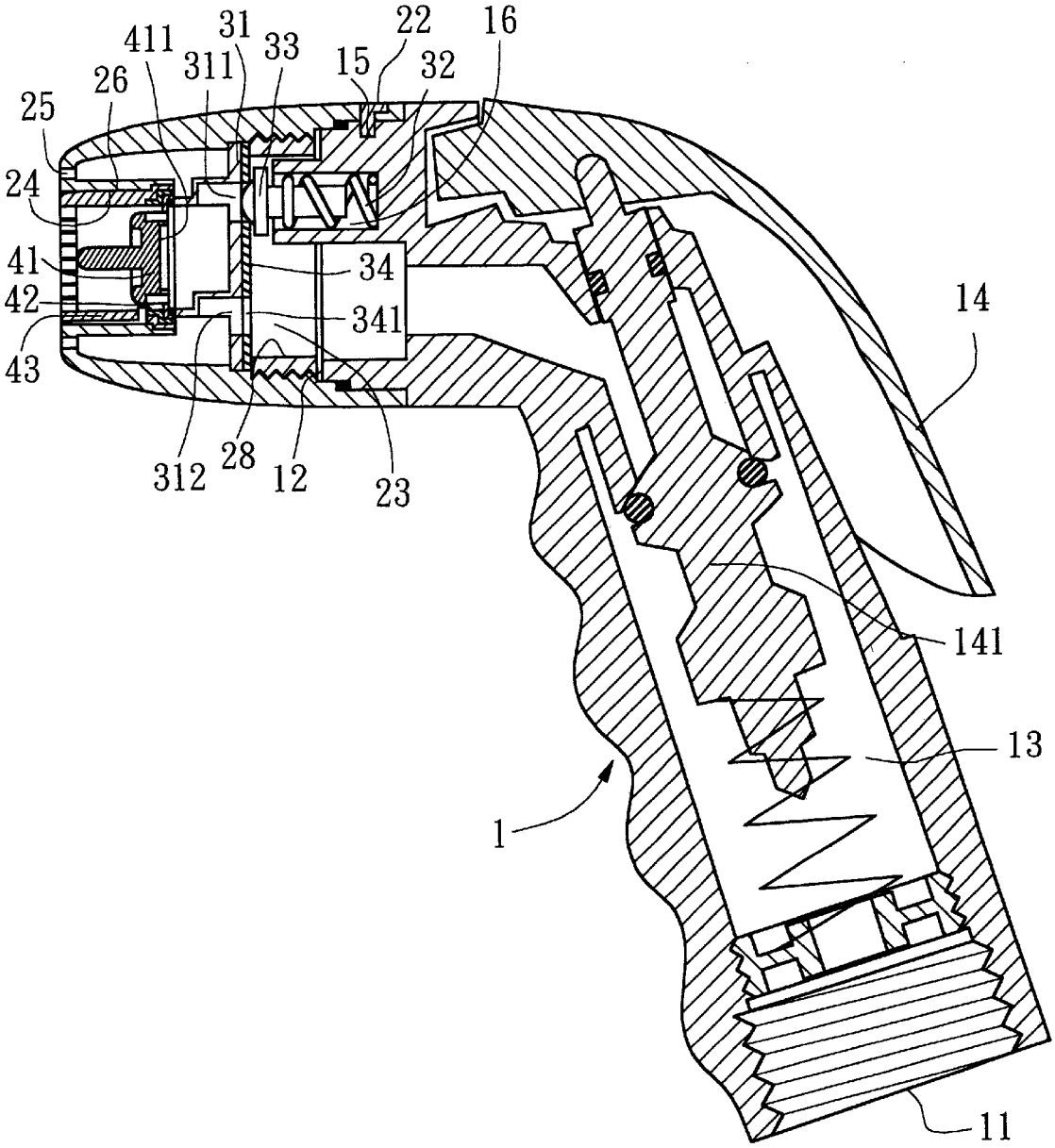
FIG. 2 is a sectional assembled view of the present invention.
Figure 3:
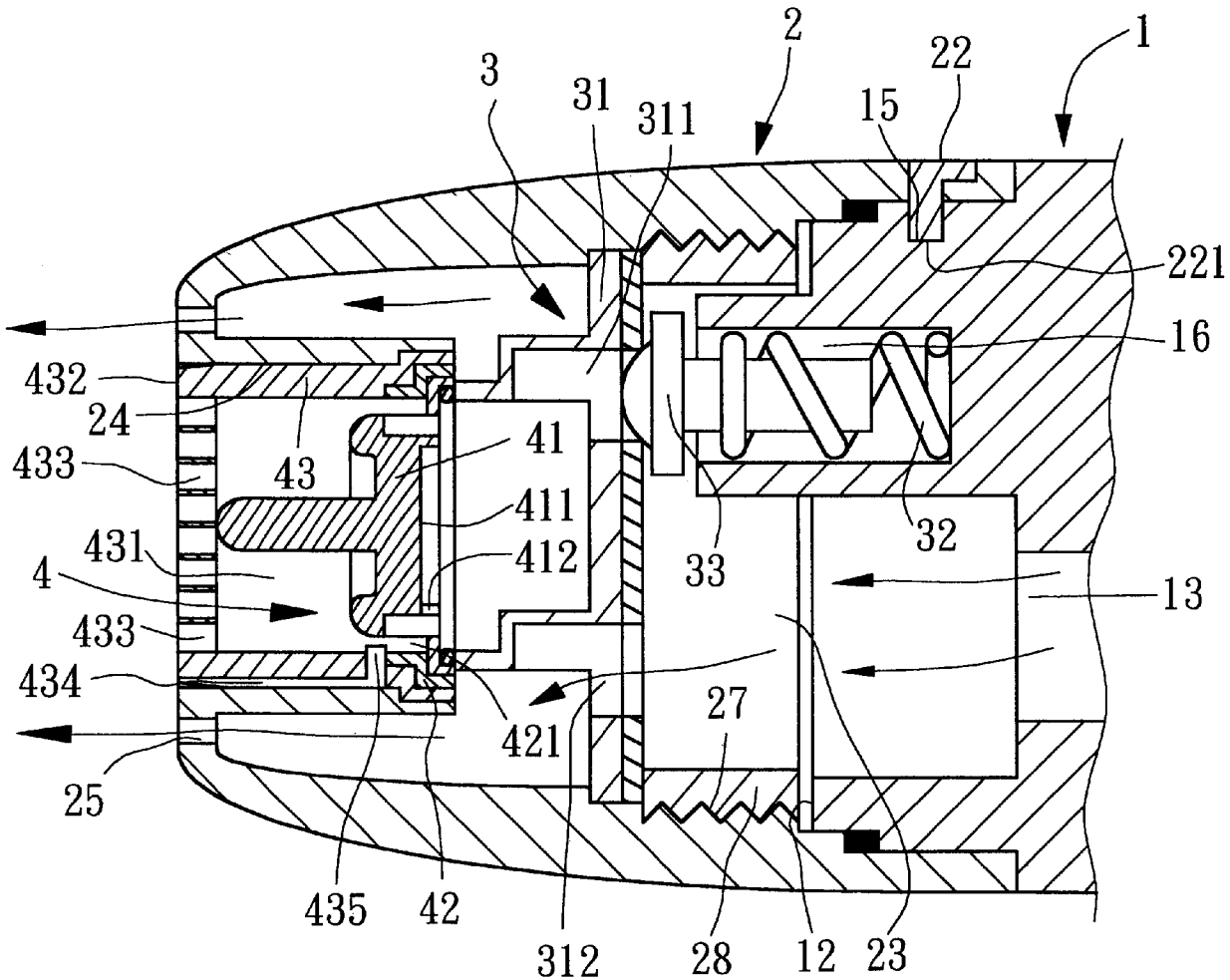
FIG. 3 is an enlarged sectional view of the switch unit of the present invention, in which the water is discharged from the circumferential outlet section.

Please refer to FIGS. 1 to 3. The kitchen-used sprinkling gun of the present invention includes a main body 1, a cap body 2 and a switch unit 3.

One end of the main body 1 is an inlet end 11. The cap body 2 is rotatably disposed at the other end 12 of the main body 1 opposite to the inlet end 11. The main body 1 is formed with a flow way 13 passing through the main body 1 from the inlet end 11 to the other end 12. A press shank 14 is pivotally disposed on the main body 1 for driving a valve body 141 to control the opening/closing of the flow way 13.

The outer circumference of the cap body 2 is formed with a circumferential groove 21 longer than a semicircle of the cap body 2. Several perforations 211 are formed in the groove 21. The main body 1 is formed with an engaging groove 15 corresponding to the groove 21. A C-shaped retainer ring 22 is retained in the engaging groove 15. The C-shaped retainer ring 22 has stop blocks 221 respectively corresponding to the perforations 211. The stop blocks 221 can be passed through the perforations 211 and inlaid and engaged in the engaging groove 15 of the main body 1 so as to clockwise and counterclockwise rotatably connect the cap body 2 on the main body 1.

The cap body 2 is formed with a chamber 23. One end of the chamber 23 distal from the main body 1 is formed with a central outlet section 24 and a circumferential outlet section 25 separated from each other by an annular stop wall 26.

The switch unit 3 is disposed in the chamber 23. The cap body 2 has an inner thread section 27. A press ring 28 is screwed in the inner thread section 27 for fixing the switch unit 3 in the chamber 23.

The switch unit 3 includes a water dividing disc 31 and a set of wave generator 4. The outer circumference of the water dividing disc 31 is formed with two cuts 313 radially opposite to each other. The cap body is formed with projecting blocks 29 respectively corresponding to the cuts 313. The cuts 313 of the water dividing disc 31 are fixedly engaged with the projecting blocks 29, whereby the water dividing disc 31 is rotatable along with the cap body 2.

A spring 32 and a valve body 33 are disposed between the water dividing disc 31 and the main body 1. The main body 1 has a locating section 16 for locating one end of the spring 32. The other end of the spring 32 serves to push the valve body 33. The water dividing disc 31 is formed with a first dividing hole 311 and a second dividing hole 312 corresponding to the valve body 33. The spring 32 can resiliently push the valve body 33 to optionally block the first or second dividing hole 311, 312 of the water dividing disc 31. The first and second dividing holes 311, 312 respectively communicate with the central outlet section 24 and the circumferential outlet section 25 of the cap body 2.

A soft water sealing plate 34 is disposed on one side of the water dividing disc 31 adjacent to the valve body 33. The water sealing plate 34 is formed with conducting holes 341 respectively corresponding to the first and second dividing holes 311, 312 of the water dividing disc 31. The valve body 33 is adapted to abut against the circumferences of the conducting holes 341 to seal the first and second dividing holes 311, 312.

The water generator 4 is disposed between the first dividing hole 311 of the water dividing disc 31 and the central outlet section 24 of the cap body 2. The water generator 4 is composed of a water regulating tray 41, a ring body 42 and a hollow housing 43.

The water regulating tray 41 is adjacent to the first dividing hole 311 and formed with a recessed section 411 corresponding to the first dividing hole 311. The water regulating tray 41 is further formed with several through holes 412 radially passing through the recessed section 411.

The ring body 42 is fitted around the water regulating tray 41. One end of the ring body 42 adjacent to the first dividing hole 311 is tightly engaged with the water regulating tray 41. A gap 421 is defined between the ring body 42 and the water regulating tray 41, whereby the water can flow out from the through hole 412 through the gap 421.

The housing 43 has a hollow section 431 in which the ring body 42 is fitted. One end of the housing 43 adjacent to the first dividing hole 311 is tightly engaged with the ring body 42. The housing 43 is fitted in the central outlet section 24. One end of the housing 43 distal from the ring body 42 is defined as a front end 432. The front end 432 is formed with several outlets 433. The outer circumference of the housing 43 is formed with several ventilating channels 434 axially extending and open at the front end 432. Each ventilating channel 434 has a vent 435 radially passing through the housing 43, whereby air can go from the ventilating channel 434 through the vent 435 to the hollow section 431 of the housing 43.

After assembled, the valve body 33 is pushed by the spring 32 to abut against the circumference of one of the conducting holes 341 of the water sealing plate 34 to seal the first dividing hole 311 or second dividing hole 312 of the water dividing disc 31. The spring 32 also radially locates the water dividing disc 31.

The stop blocks 221 of the C-shaped retainer ring 22 are engaged in the engaging groove 15 of the main body 1, whereby the cap body 2 can be rotated on the main body 1 about the axis thereof. The cuts 313 of the water dividing disc 31 are engaged with the projecting blocks 29 of the cap body 2. Therefore, when a user turns the cap body 2, the water dividing disc 31 and the water sealing plate 34 will be rotated along with the cap body 2. At this time, the valve body 33 will be moved from one of the conducting holes 341 to the other.

The two conducting holes 341 of the water sealing plate 34 respectively communicate with the first and second dividing holes 311, 312 of the water dividing disc 34. Therefore, when the user turns the cap body 2, the valve body 33 will seal the first dividing hole 311 or the second dividing hole 312 to change the flowing path of the water and form different discharging patterns.

When the valve body 33 seals the first dividing hole 311 as shown in FIG. 3, the water will flow from the way flow 13 into the chamber 23 of the cap body 2 and flow through the second dividing hole 312 into the circumferential outlet section 25 of the cap body 2. The water beams are then directly outward injected to clean up the oily dirt from the dish.

Figure 4:
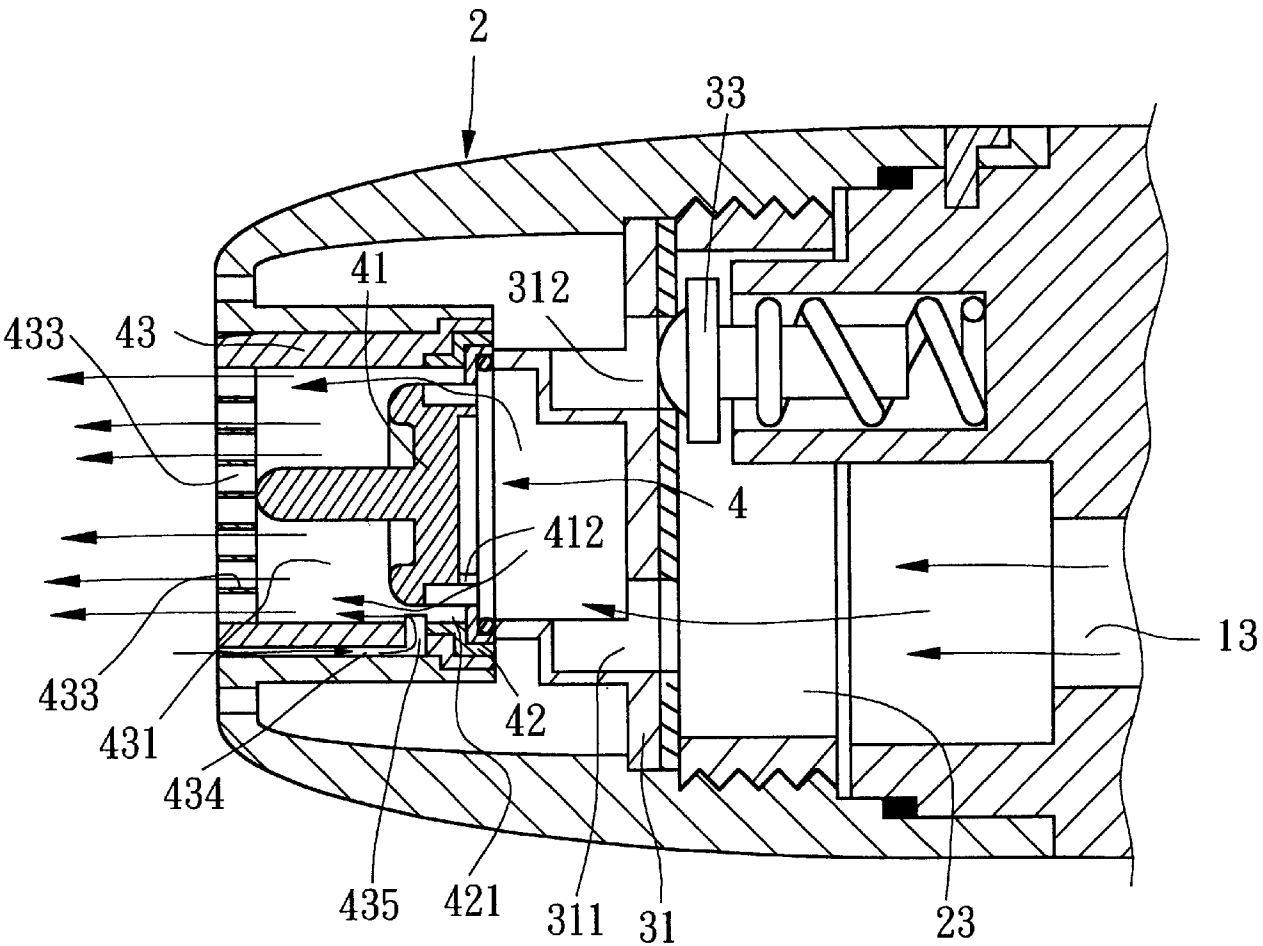
FIG. 4 is an enlarged sectional view of the switch unit of the present invention, in which the water is discharged from the central outlet section.
Figure 5:
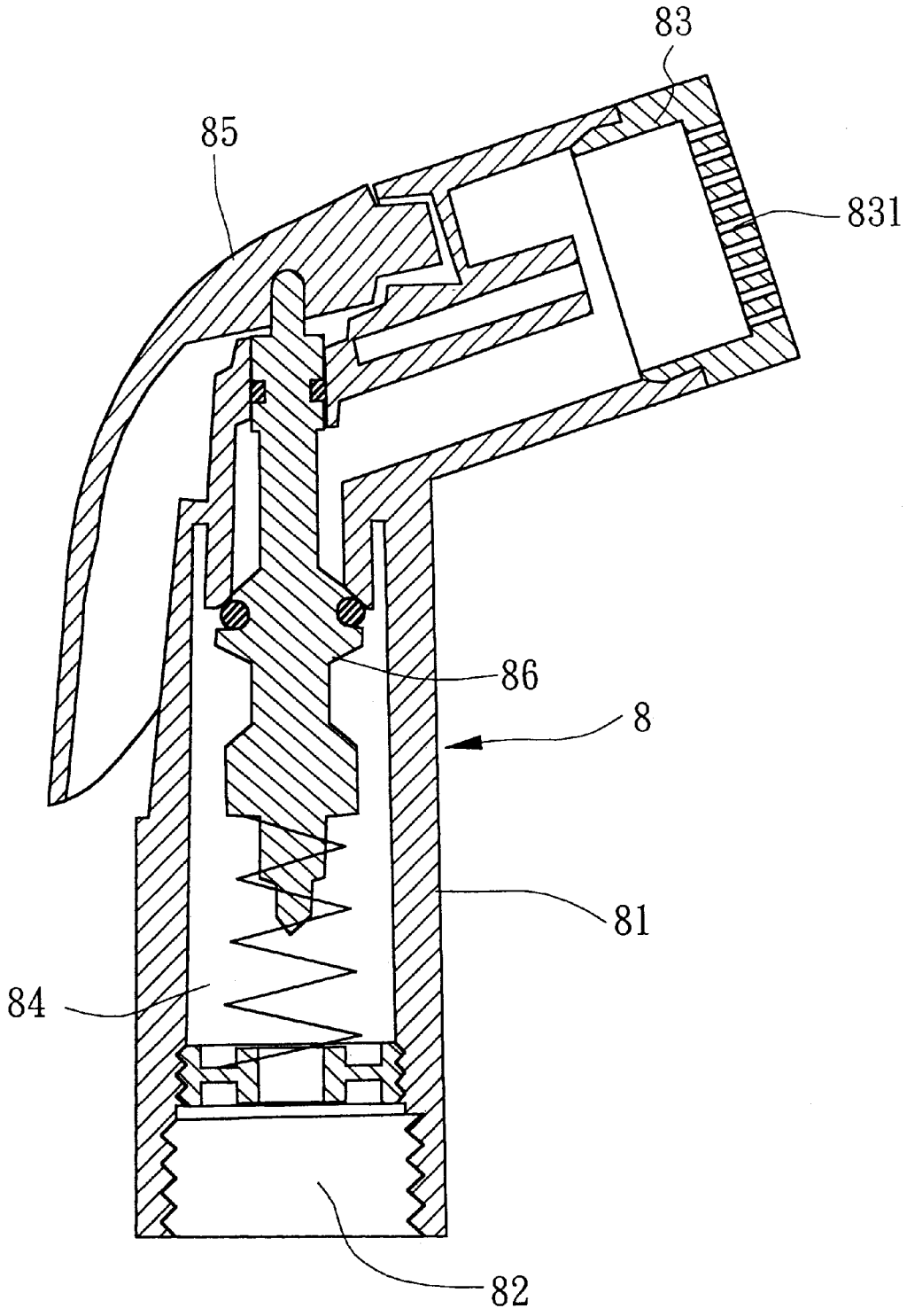
Prior Art FIG. 5
FIG. 5 is a sectional view of a conventional kitchen-used sprinkling gun.

After the user turns the cap body 2 to drive and rotate the water dividing disc 31, the valve body 33 will turn to seal the second dividing hole 312 as shown in FIG. 4. At this time, the water will flow from the way flow 13 into the chamber 23 of the cap body 2 and then flow through the first dividing hole 311 into the wave generator 4. Thereafter, the water will flow from the recessed section 411 of the water regulating tray 41 through the through holes 412 and flow through the gap 421 between the water regulating tray 41 and the ring body 42 into the hollow section 431 of the housing 43. Finally, the water concentratively flows out from the outlet 433 of the housing 43. When the water flows in the hollow section 431, the external air is sucked in from the ventilating channels 434 and goes from the vents 435 into the hollow section 431 to mix with the water. Accordingly, a wave generating effect is provided for the water for washing the dish without splashing around.

According to the above, the present invention has the following advantages:

1. The water dividing disc 31 and the valve body 32 of the switch unit 3 cooperate with each other to switch the water paths. The water dividing disc 31 and the valve body 32 have simple structures so that even if the volume of the kitchen-used sprinkling gun is limited, the kitchen-used sprinkling gun can be still switched between a directly injecting mode and a wave generating mode. When not used, the kitchen-used sprinkling gun occupies less room.
2. In use, by means of easily turning the cap body 2, the position of the water dividing disc 31 can be changed, whereby the valve body 33 can seal the first dividing hole 311 or the second dividing hole 312 to switch the discharging modes.
3. The valve body 33 is pushed by the spring 32 to abut against the circumference of the conducting holes 341 of the water sealing plate 34 to seal the first dividing hole 311 or second dividing hole 312 of the water dividing disc 31. In addition, the spring 32 also radially locates the water dividing disc 31. Therefore, it is unnecessary to additionally provide a locating structure for the water dividing disc 31.

The above embodiment is only used to illustrate the present invention, not intended to limit the scope thereof. Many modifications of the above embodiment can be made without departing from the spirit of the present invention.

What is claimed is:

1. A kitchen-used sprinkling gun comprising a main body, a cap body and a switch unit, one end of the main body being an inlet end, the cap body being clockwise and counter-clockwise rotatably disposed at the other end of the main body opposite to the inlet end, the main body being formed with a flow way passing through the main body from the inlet end to the other end, a press shank being disposed on the main body for controlling opening/closing of the flow way, the cap body being formed with a chamber, one end of the chamber distal from the main body being formed with a central outlet section and a circumferential outlet section separated from each other by an annular stop wall, the switch unit being disposed in the chamber, the switch unit including a water dividing disc, a spring and a valve body being disposed between the water dividing disc and the main body, the main body having a locating section for locating one end of the spring, the other end of the spring serving to push the valve body, the water dividing disc being formed with a first dividing hole and a second dividing hole corresponding to the valve body, whereby the spring can resiliently push the valve body to seal the first or second dividing hole of the water dividing disc, the first and second dividing holes respectively communicating with the central outlet section and the circumferential outlet section of the cap body, a water generator being disposed between the first dividing hole and the central outlet section.

2. The kitchen-used sprinkling gun as claimed in claim 1, wherein the outer circumference of the cap body is formed with a circumferential groove longer than a semicircle of the cap body, more than one perforation being formed in the groove, the main body being formed with an engaging groove corresponding to the groove, a C-shaped retainer ring being retained in the engaging groove, the C-shaped retainer ring having stop blocks respectively corresponding to the perforations, whereby the stop blocks can be passed through the perforations and inlaid and engaged in the engaging groove of the main body.

3. The kitchen-used sprinkling gun as claimed in claim 1, wherein the cap body has an inner thread section, whereby a press ring is screwed in the inner thread section for fixing the switch unit in the chamber of the cap body.

4. The kitchen-used sprinkling gun as claimed in claim 1, wherein the outer circumference of the water dividing disc is formed with more than one cut, the cap body being formed with projecting blocks corresponding to the cut, whereby the cut of the water dividing disc is fixedly engaged with the projecting block.

5. The kitchen-used sprinkling gun as claimed in claim 1, wherein a soft water sealing plate is disposed on one side of the water dividing disc adjacent to the valve body, the water sealing plate being formed with conducting holes. respectively corresponding to the first and second dividing holes of the water dividing disc, the valve body being adapted to abut against the circumferences of the conducting holes to seal the first or second dividing hole.

6. The kitchen-used sprinkling gun as claimed in claim 1, wherein the water generator is composed of a water regulating tray, a ring body and a hollow housing, the water regulating tray being adjacent to the first dividing hole and formed with a recessed section corresponding to the first dividing hole, the water regulating tray being further formed with several through holes radially passing through the recessed section, the ring body being fitted around the water regulating tray, one end of the ring body adjacent to the first dividing hole being tightly engaged with the water regulating tray, a gap being defined between the ring body and the water regulating tray, whereby the water can flow out from the through hole through the gap, the housing having a hollow section in which the ring body is fitted, one end of the housing adjacent to the first dividing hole being tightly engaged with the ring body, the housing being fitted in the central outlet section, one end of the housing distal from the ring body being defined as a front end, the front end being formed with several outlets, the outer circumference of the housing being formed with more than one ventilating channel axially extending and open at the front end, each ventilating channel having a vent radially passing through the housing, whereby air can go from the ventilating channel through the vent to the hollow section of the housing.

* * * * *